US005732516A

United States Patent [19]

Ellsworth

[11] Patent Number: 5,732,516

[45] Date of Patent: Mar. 31, 1998

[54] SIGN SUPPORT ANCHOR

[75] Inventor: Steven J. Ellsworth, Walnut, Calif.

[73] Assignee: Western Highway Products, Inc., Stanton, Calif.

[21] Appl. No.: 735,074

[22] Filed: Oct. 18, 1996

[51] Int. Cl.[6] ..... E02D 5/74

[52] U.S. Cl. ..... 52/155; 52/720.1; 52/736.1; 248/156; 40/607

[58] Field of Search ..... 40/607, 606, 610; 243/156, 545; 52/164.13, 155, 165, 720.1, 733.2, 736.1, 731.4, 737.6, 732.3; 256/DIG. 5, 22, 34, 59

[56] References Cited

U.S. PATENT DOCUMENTS 4,558,545 12/1985 Lindner ..... 52/169.13
4,989,390 2/1991 Moore, III ..... 52/720.1

OTHER PUBLICATIONS

"Ulti-Mate Product Specifications, Metric System, 12 Gage," Western Highway Products, Inc., Aug. 28, 1996 brochure.

"Ulti-Mate Product Specifications, Metric System, 14 Gage," Western Highway Products, Inc., Aug. 28, 1996 brochure.

"Ulti-Mate Product Specifications, English System, 12 Gage," Western Highway Products, Inc., Aug. 28, 1996 brochure.

"Ulti-Mate Product Specifications, English System, 14 Gage," Western Highway Products, Inc., Aug. 28, 1996 brochure.

"Ulti-Mate EZ Post Selection Guide," Western Highway Products, Inc., Aug. 28, 1996 brochure.

"Introducing Ulti-Mate, The Ultimate Sign Supporting System," Western Highway Products, Inc., 1996.

"Telespar Square Tube Sign Supports," Unistrut, 1995 brochure.

"Allied Square Tube Signposts," Allied Tube & Conduit Corp., Feb. 1992 brochure.

*Primary Examiner*—Christopher Kent
*Assistant Examiner*—Yvonne Horton-Richardson
*Attorney, Agent, or Firm*—Christie, Parker & Hale, LLP

[57] ABSTRACT

An improved anchor for a sign support includes a square tube having a plurality of holes along a center line on at least two opposing sides or all four sides. One end of the square tube has two points at opposing corners of the square tube and edges connecting the two points to the sides of the square tube to facilitate easier insertion of the anchor into the ground.

7 Claims, 3 Drawing Sheets

19

19
20a
20
19
20a
20
16
26a
28a
14
22a
18
18
18
18
45°
18
26
24
26
24
26
28
22
10
10
10
10

SIGN SUPPORT ANCHOR

FIELD OF THE INVENTION

This invention relates generally to sign support systems and more specifically to an anchor for a sign support which can be easily driven into the ground.

BACKGROUND OF THE INVENTION

Traffic signs are the primary source of information for motorists. The biggest and brightest sign is only effective if the support it is mounted on keeps the sign in its intended position. Sign supports need to be strong, versatile, and cost effective. Although a sign post can be installed directly into the ground using power equipment or a sledge-hammer with a driving cap, use of an anchor system allows construction crews to work at ground level for faster installation and replacement of signs. Sign posts must also be capable of breaking in the event of an impact by a vehicle or the like. The anchor allows an upright post to be inserted into the anchor and when the post is broken, it is easily replaced in the anchor by a new post. The anchor is installed directly into the ground, and the sign post telescopically slides into and is affixed to the anchor. Although the anchor improves the overall efficiency of sign installation and replacement, the anchor must still be driven into the ground in the same manner as a sign post. This operation is problematic if compacted dirt, roots, or other debris are in the intended insertion path of the anchor. Modifications to the anchor providing for easier insertion into the ground are desirable.

SUMMARY OF THE INVENTION

An embodiment of the present invention provides an anchor for a sign support system which can be easily driven into the ground with a minimum of force.

Additional advantages and novel features of the invention will be set forth in part in the description which follows, and will become apparent to those skilled in the art upon examination of the following or may be learned by practice of the invention.

According to one embodiment of the present invention, the foregoing and other advantages are attained by a sign support anchor made of a square tube having first and second open ends and first, second, third and fourth sides, the first side opposite the second side and the third side opposite the fourth side, a first vertex at the first open end connecting the first and third sides, a second vertex at the first open end connecting the second and fourth sides, a third vertex at the first open end connecting the first and fourth side, and a fourth vertex at the first open end connecting the second and third sides, wherein each of the third vertex and the fourth vertex are a first distance from the second open end and each of the first vertex and the second vertex are a second distance from the second open end, the first distance being greater than the second distance. All edges connecting the vertices are cut so as to have a beveled edge of 59 to 61 degree, preferably at a 60 degree angle to the corresponding side.

In another embodiment of the present invention, a method of making a sign support anchor includes the steps of positioning the tube that is square in cross section on a horizonal axis; cutting the third side from a first location on the corner between the first and third sides to the fourth vertex and the second side from a second location on the corner between the second and fourth sides to the fourth vertex; rotating the square tube a further 180 degrees on the horizontal axis; cutting the first side from the first location to the third vertex and the fourth side from the second location to the third vertex, whereby the square tube results in having the third vertex and the fourth vertex a first distance from the second open end and the first location and the second location a second distance from the second open end, the first distance being greater than the second distance. The protruding third vertex and fourth vertex function as initial points of contact with the ground during anchor insertion.

Still other objects and advantages of the present invention will become readily apparent to those skilled in the art from the following detailed description, wherein is shown and described only the preferred embodiment of the invention, simply by way of illustration of the best mode contemplated for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF THE PREFERRED EMBODIMENT

The present invention is an anchor used to support a sign post. The anchor is cut in such a manner as to provide two sharpened and pointed edges to facilitate the insertion of the anchor into the ground.

Figure 1:
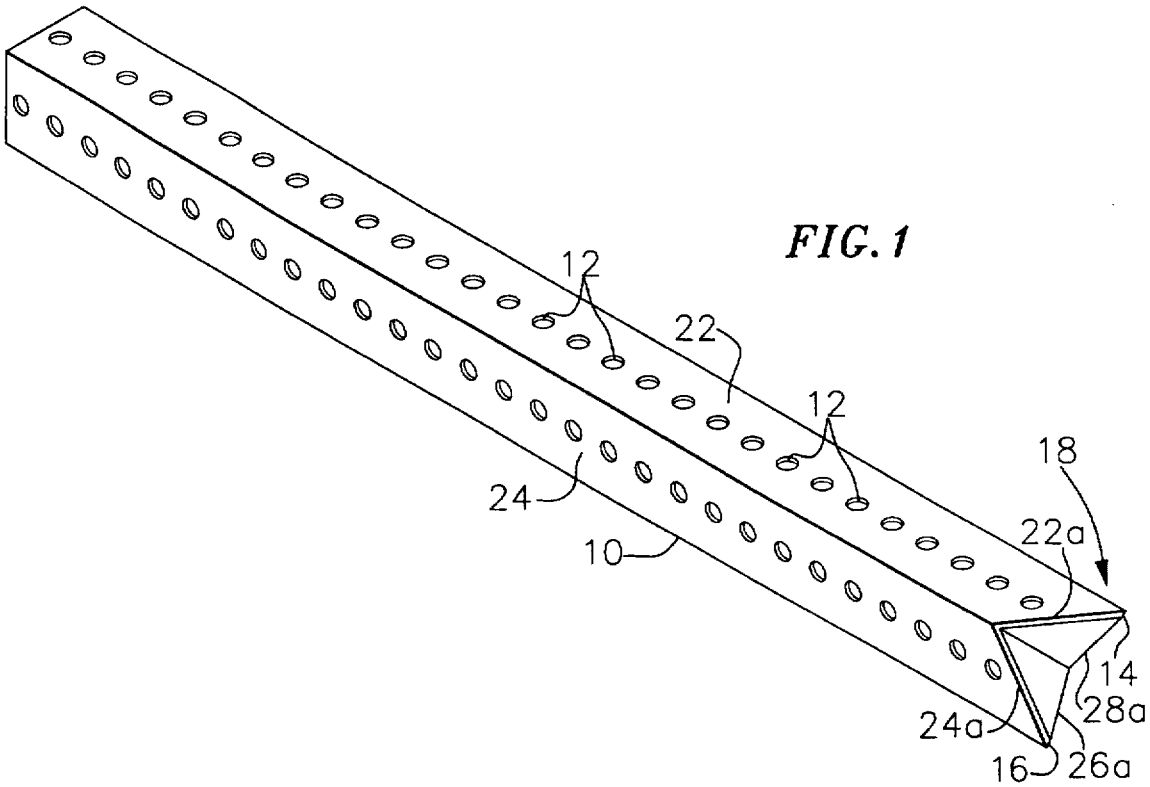
FIG. 1 is a perspective view of the anchor of the present invention.

FIG. 1 is a perspective view of the anchor of the present invention. In the preferred embodiment, the anchor 10 is roll formed from steel conforming to Standard Specifications for Steel Sheet, A.S.T.M. A653-94, Structural Quality. The cross section of the anchor is square tubing, formed of 12 gauge steel sheet and welded so that the weld flash will not interfere with the similarly constructed sign post which is telescopically inserted into the anchor. The anchor 10 may be a cross-sectional 2.0 in. by 2.0 in. square of 12 gauge steel to receive a 1.75 in. by 1.75 in. square sign post, a 2.25 in. by 2.25 in. square of 12 gauge steel to receive a 2.0 in. by 2.0 in. square sign post, or a 2.5 in. by 2.5 in. square of 12 gauge steel to receive a 2.25 in. by 2.25 in. square sign post. Other dimensions may be used as required. When the anchor is 12 gauge steel, the thickness of each wall is preferably 0.105 in. The length of the anchor 10 may be any suitable length for receiving the sign post given the current ground conditions. The anchor 10 has a plurality of 7/16 in. holes 12 on 1 in. centers on either two opposite sides or on all four sides for allowing mounting of the sign post to the anchor. The holes are on the centerline of each anchor side in true alignment and opposite to each other.

The anchor 10 is cut by a circular saw 20 with two diagonal cuts to provide, as depicted in FIGS. 1, 5, 6 and 7, sharpened edges 22, 24, 26, and 28 leading to two points 14, 16 on one end 18 of the anchor 10. When the anchor is driven into the ground with the end 18 pointed down, the sharpened points and edges cut into hard soil, sever roots, and deflect other debris. The angle of the edges force dirt sideways out of the insertion path of the anchor as it is being driven into the ground, thereby providing a considerable efficiency to the insertion operation. The angle on edges 22*a*, 24*a*, 26*a*, and 28*a* is in the range of 59 to 61 degrees to corresponding sides 22, 24, 26, and 28, with an angle of 60 degrees being preferred. The anchor is also more stable when being driven into the ground because of the sharpened points and angled edges. Insertion of the anchor of the present invention is easier and faster than an anchor without the specially cut edges and points.

Figures 2A, 2B, 3A, 3B, 4, 5:
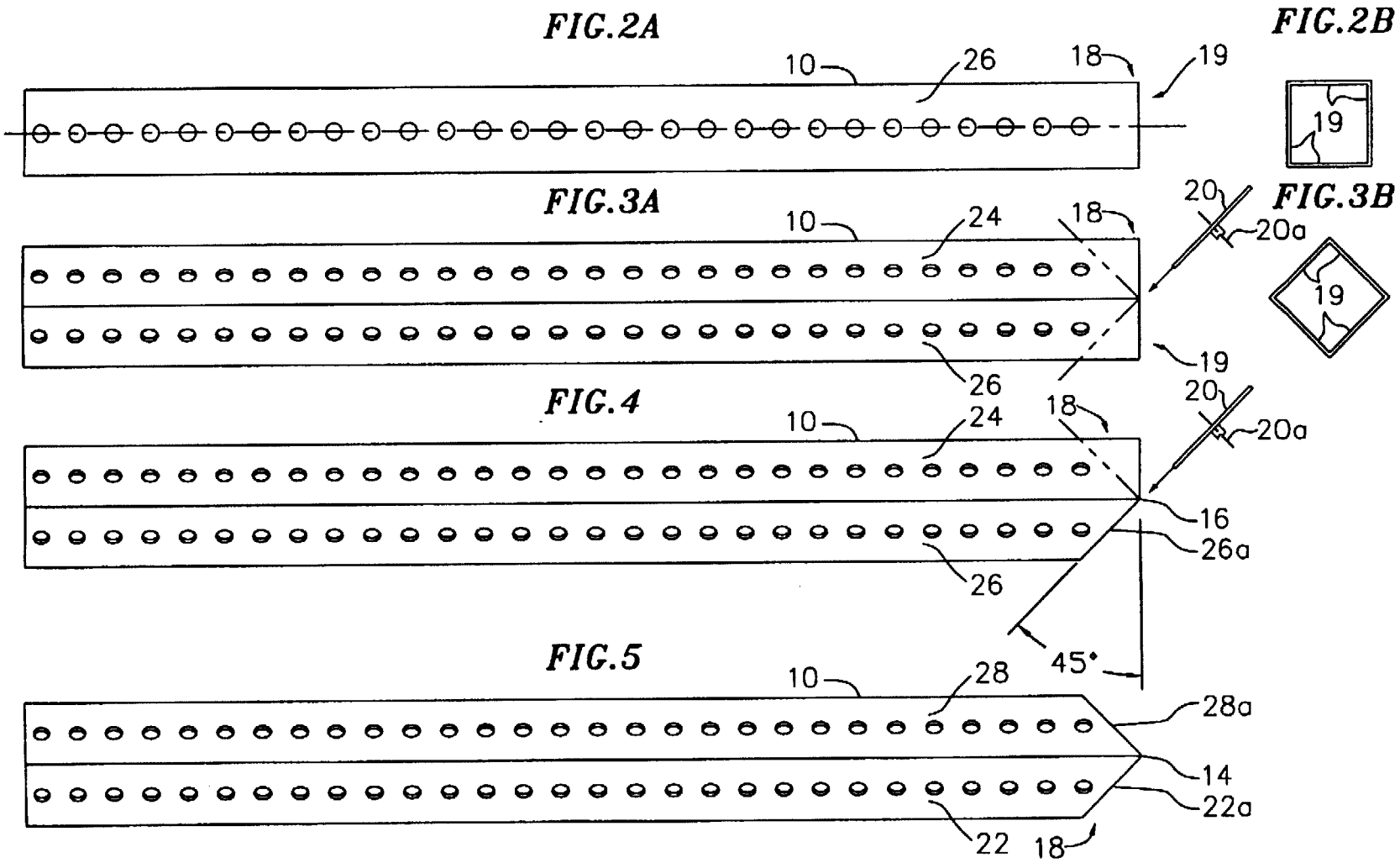
FIG. 2A is a plan view of the anchor before cutting.
FIG. 2B is an end view of one side of the anchor of FIG. 2A before cutting.
FIG. 3A is a view of the anchor before cutting rotated 45 degrees about the horizontal axis from the view of FIG. 2A.
FIG. 3B is an end view of the anchor of FIG. 3A before cutting.
FIG. 4 is a view of the anchor of FIG. 3A after one cut has been made.
FIG. 5 is a view of the anchor rotated 180 degrees about the horizontal axis from FIG. 4 after two cuts have been made.

FIG. 2A is a plan view of an anchor before cutting. Initially, the end 18 of the anchor has an edge 19 which is 90 degrees relative to the adjacent sides 22, 24, 26, and 28 as a result of the cutting of the square tubing into appropriate lengths. FIG. 2B is an end view of one side of the anchor of FIG. 2A before cutting. FIG. 3A is a view of the anchor before cutting rotated 45 degrees about the horizontal axis from the view of FIG. 2A. FIG. 3B is an end view of the anchor of FIG. 3A before cutting. Circular saw 20 makes an angled cut across the lower half of the anchor starting at the corner between sides 24 and 26 of the anchor's end, producing edges 26*a* and 28*a* adjacent sides 26 and 28. The angle of the edges 26*a* and 28*a* relative to sides 26 and 28, respectively, is 60 degrees. In the preferred embodiment, the cutting angle is in the range of 30 to 60 degrees, with 45 degrees being preferred. The anchor 10 is then rotated 180 degrees to the position shown in FIG. 5. Circular saw 20 then makes another cut, at 45 degrees to the length of anchor 10 starting at the edge between sides 22 and 28 towards the outer edge between side 22 and 24, producing edges 22*a* and 24*a*. Again, edges 22*a* and 24*a* are 60 degrees relative to their respective sides 22 and 24.

Thus circular saw 20 cuts away two connected triangle-shaped portions on two adjoining sides of the anchor on each cut. Each connected triangle-shaped portion is integral along a line formerly in a corner of the square tube. FIG. 5 is a view of the anchor rotated 180 degrees about the horizontal axis from FIG. 4 after two cuts have been made. The anchor now has two sharpened points 14, 16 formed on the end 18, only one of which is visible in FIG. 5.

Figure 6:
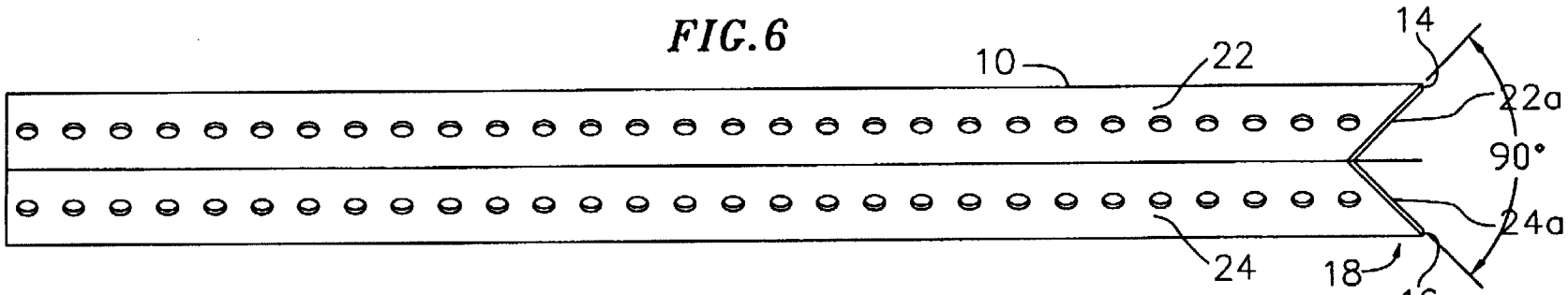
FIG. 6 is a view of the anchor of FIG. 5 rotated 90 degrees about the horizontal axis from the position in FIG. 5.
Figure 7:
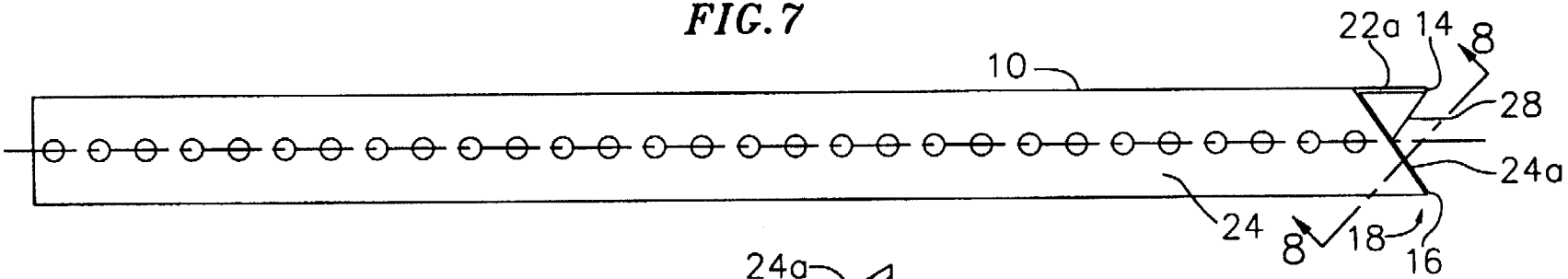
FIG. 7 is a side view of the anchor of FIG. 6 rotated 45 degrees from the position in FIG. 6.
Figure 8:
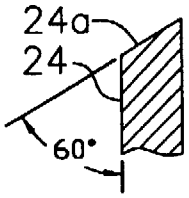
FIG. 8 is a cross-sectional view of the anchor along edge 24 taken along the lines 8—8 of FIG. 7.

FIG. 6 is a view of the anchor of FIG. 5 rotated 90 degrees about the horizontal axis from the position in FIG. 5. In the preferred embodiment, the angled cuts of 45 degrees result in an interior angle of 90 degrees between the two sharpened points 14, 16. If cuts of a different angle are used, then the resulting interior angle will change accordingly. FIG. 7 is a side view of the anchor of FIG. 6 rotated 45 degrees from the position in FIG. 6. One skilled in the art can readily see the configuration of the end 18 of anchor 10 resulting from the two cuts. FIG. 8 is a cross-sectional view of the anchor along edge 24 taken along the lines 8—8 of FIG. 7.

The invention has been described in its presently contemplated best mode, and it is clear that it is susceptible to various modifications, modes of operation and embodiments, all within the ability and skill of those skilled in the art and without the exercise of further inventive activity. Accordingly, what is intended to be protected by Letters patent is set forth in the appended claims.

What is claimed is:

1. An anchor for a sign support comprising:

a tube that is square in cross-section and having first and second open ends and first, second, third and fourth sides, the first side opposite the second side and the third side opposite the fourth side, a first vertex at the first open end connecting the first and third sides, a second vertex at the first open end connecting the second and fourth sides, a third vertex at the first open end connecting the first and fourth side, and a fourth vertex at the first open end connecting the second and third sides, wherein each of the third vertex and the fourth vertex are at a first distance from the second open end and each of the first vertex and the second vertex are at a second distance from the second open end, the first distance being greater than the second distance.

2. The anchor of claim 1 further comprising a first edge connecting the first vertex and the third vertex, a second edge connecting the second vertex and the fourth vertex, a third edge connecting the first vertex to the fourth vertex, and a fourth edge connecting the second vertex and the third vertex, wherein a first angle between the first edge and the third side is approximately 45 degrees, a second angle between the second edge and the fourth side is approximately 45 degrees, a third angle between the third edge and the first side is approximately 45 degrees, and a fourth angle between the fourth edge and the second side is approximately 45 degrees.

3. The anchor of claim 2, wherein the first edge forms a surface of the square tube at an angle of approximately 60 degrees in relation to the first side, the second edge forms a surface of the square tube at an angle of approximately 60 degrees in relation to the second side, the third edge forms a surface of the square tube at an angle of approximately 60 degrees in relation to the third side, and the fourth edge forms a surface of the square tube at an angle of approximately 60 degrees in relation to the fourth side.

4. The anchor of claim 3 further comprising a plurality of holes in at least two opposing sides wherein the plurality of holes in a first side are aligned with the plurality of holes in a second, opposing side.

5. A method of making an anchor for sign support from a tube that is square in cross-section and having first and second open ends and first, second, third and fourth sides, the first side opposite the second side and the third side opposite the fourth side, a third vertex at the first open end connecting the first and fourth side, and a fourth vertex at the first open end connecting the second and third sides, the method comprising the steps of:

(A) positioning the square tube at a first position;

(B) cutting the third side from a first location on the corner between the first and third sides to the fourth vertex and the second side from a second location on the corner between the second and fourth sides to the fourth vertex;

(C) rotating the square tube 180 degrees about a the horizontal axis of the square tube;

(D) cutting the first side from the first location to the third vertex and the fourth side from the second location to the third vertex, whereby the square tube results in having the third vertex and the fourth vertex at a first distance from the second open end and the first location and the second location at a second distance from the second open end, the first distance being greater than the second distance.

6. The method of claim 5 wherein after steps (B) and (D) the anchor has a first edge connecting the first location and the third vertex, a second edge connecting the second location and the fourth vertex, a third edge connecting the first location to the fourth vertex, and a fourth edge connecting the second location and the third vertex, and the anchor has a first angle between the first edge and the third side of approximately 45 degrees, a second angle between the second edge and the fourth side of approximately 45 degrees, a third angle between the third edge and the first side of approximately 45 degrees, and a fourth angle between the fourth edge and the second side of approximately 45 degrees.

7. The method of claim 5, wherein each step of cutting is made with a saw blade oriented at an angle of 45 degrees to the length of the tube.

* * * * *